US006659747B2

(12) United States Patent
Yamamoto et al.

(10) Patent No.: US 6,659,747 B2
(45) Date of Patent: Dec. 9, 2003

(54) SHAFT SEAL STRUCTURE OF VACUUM PUMPS

(75) Inventors: Shinya Yamamoto, Kariya (JP); Masahiro Kawaguchi, Kariya (JP); Satoshi Egashira, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/085,843

(22) Filed: Feb. 26, 2002

(65) Prior Publication Data

US 2002/0150494 A1 Oct. 17, 2002

(30) Foreign Application Priority Data

Feb. 28, 2001 (JP) ..... 2001-054451

(51) Int. Cl.[7] ..... F04C 18/18; F04C 27/00

(52) U.S. Cl. ..... 418/104; 418/88; 418/141; 418/206.6

(58) Field of Search ..... 418/88, 104, 141, 418/206.6

(56) References Cited

U.S. PATENT DOCUMENTS 4,632,650 A 12/1986 Frieden et al. ..... 418/95
4,990,069 A * 2/1991 Guittet et al. ..... 418/141
5,009,583 A * 4/1991 Carlsson et al. ..... 418/104
5,178,529 A * 1/1993 Obrist et al. ..... 418/141
6,095,780 A * 8/2000 Ernens ..... 418/104

FOREIGN PATENT DOCUMENTS

| | | | |
|---|---|---|---|
| JP | 60-145475 | 7/1985 | |
| JP | 03-089080 | 4/1991 | |
| JP | 3-242489 | * 10/1991 | ..... 418/88 |
| JP | 06-081788 | 3/1994 | |
| JP | 06-101674 | 4/1994 | |
| JP | 09-196186 | 7/1997 | |

* cited by examiner

*Primary Examiner*—John J. Vrablik
(74) *Attorney, Agent, or Firm*—Morgan & Finnegan, LLP

(57) ABSTRACT

A Roots pump rotates a plurality of rotors by a pair of rotary shafts to draw gas. Each rotary shaft extends through a rear housing member of the Roots pump. An annular shaft seal is fitted around each rotary shaft and is received in a recess formed in the rear housing member. A labyrinth seal is located between an end surface of each shaft seal and the bottom of the associated recess. This enlarges the diameter of each labyrinth seal, thus preferably preventing oil from leaking to a pump chamber.

21 Claims, 11 Drawing Sheets

Fig.1 (c)
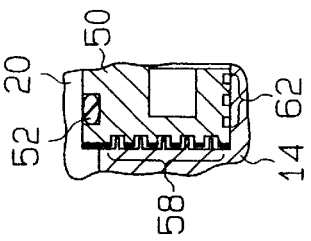
Fig.1 (b)
Fig.1 (a)
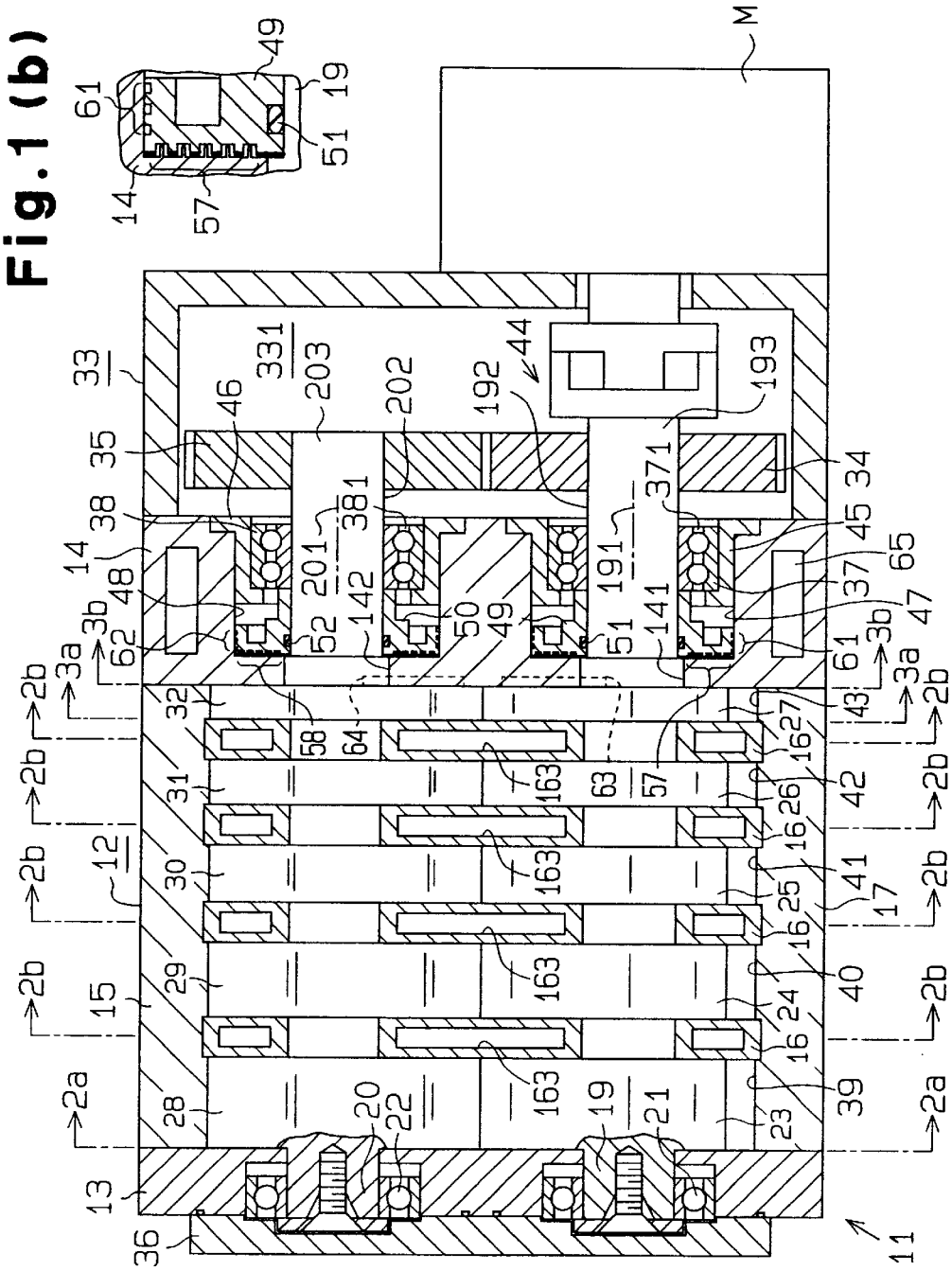

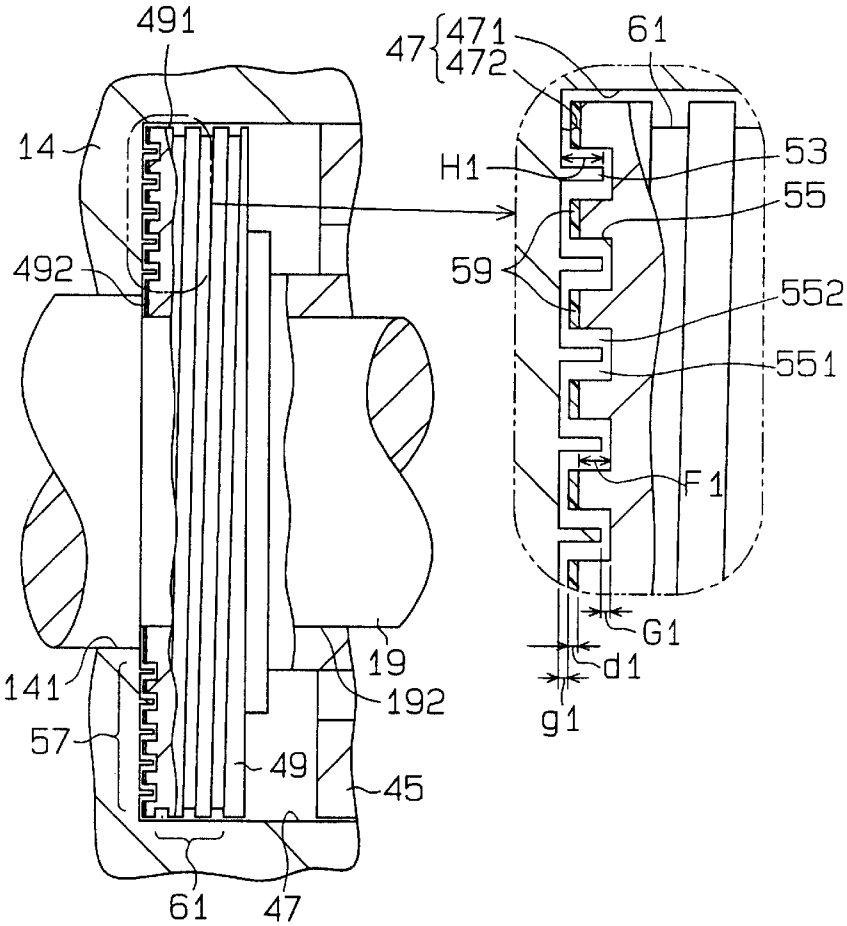
Fig.4(b)
Fig.4(c)
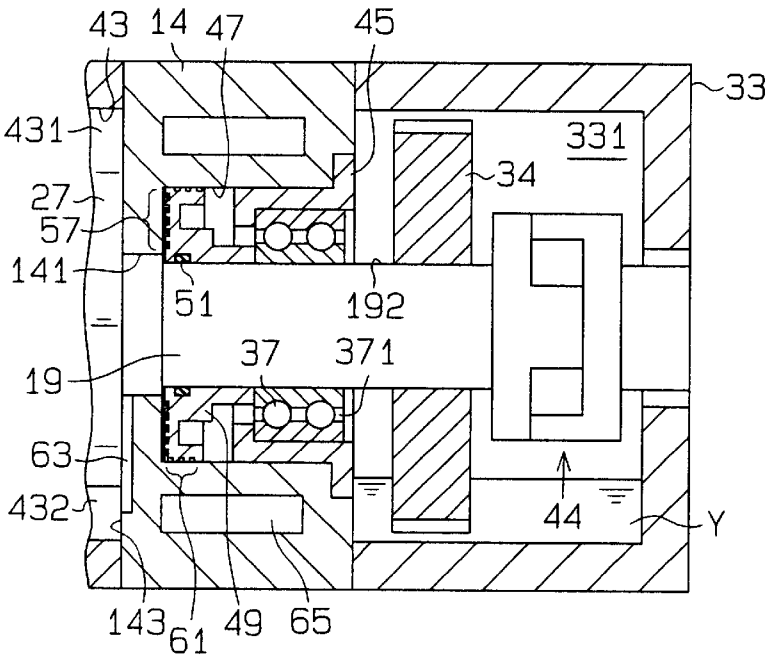
Fig.4(a)

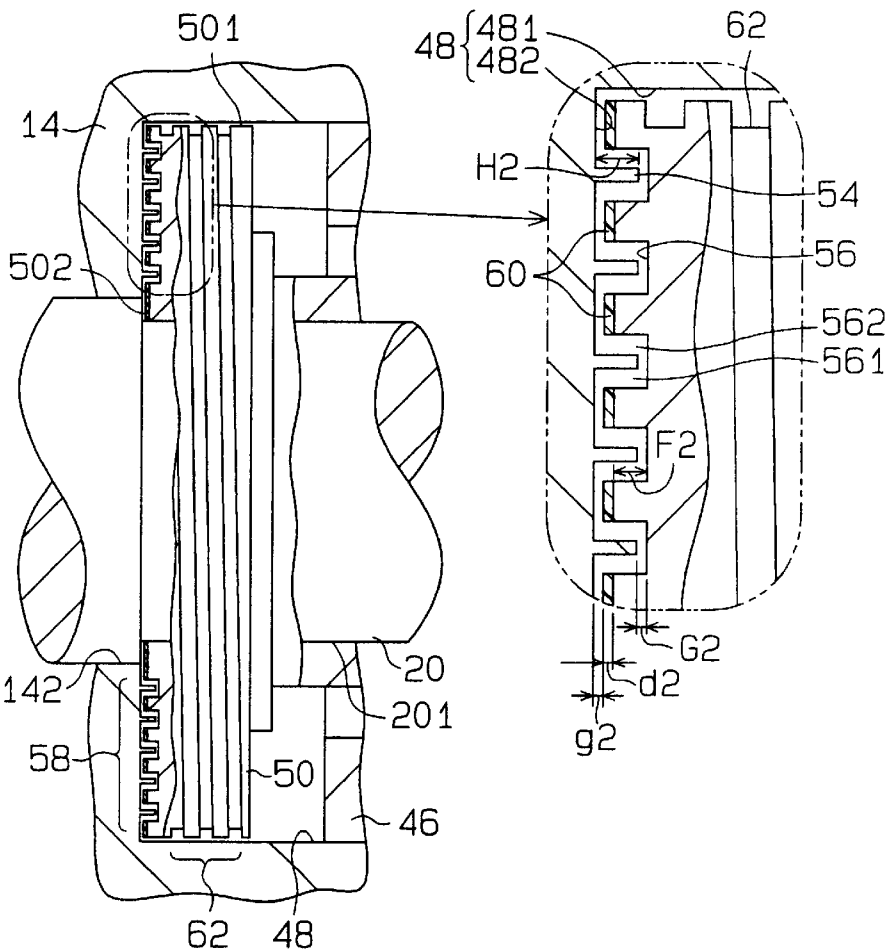
Fig.5(c)
Fig.5(b)
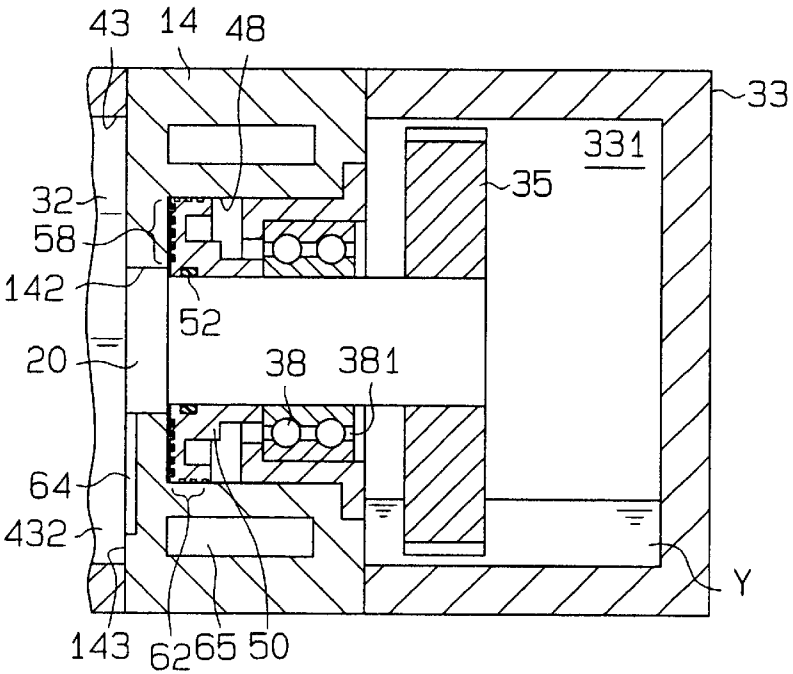
Fig.5(a)

SHAFT SEAL STRUCTURE OF VACUUM PUMPS

BACKGROUND OF THE INVENTION

The present invention relates to shaft seal structures of vacuum pumps that draw gas by operating a gas conveying body in a pump chamber through rotation of a rotary shaft.

Japanese Laid-open Patent Publication Nos. 60-145475, 3-89080, 6-101674 describe a vacuum pump that includes a plurality of rotors. Each rotor functions as a gas conveying body. Two rotors rotate as engaged with each other, thus conveying gas through a pump chamber. More specifically, one rotor is connected to a first rotary shaft and the other is connected to a second rotary shaft. A motor drives the first rotary shaft. A gear mechanism transmits the rotation of the first rotary shaft to the second rotary shaft.

The gear mechanism is located in an oil chamber that retains lubricant oil. The pump of Japanese Laid-open Patent Publication No. 60-145475 uses a labyrinth seal that seals the space between the oil chamber and the pump chamber to prevent the lubricant oil from leaking from the oil chamber to the pump chamber. More specifically, a partition separates the oil chamber from the pump chamber and has a through hole through which a rotary shaft extends. The labyrinth seal is fitted between the wall of the through hole and the corresponding portion of the rotary shaft. The pump of Japanese Laid-open Patent Publication No. 3-89080 includes a bearing chamber for accommodating a bearing that supports a rotary shaft. An intermediate chamber is formed between the bearing chamber and the pump chamber. A partition separates the bearing chamber from the intermediate chamber and has a through hole through which a rotary shaft extends. A labyrinth seal is fitted between the wall of the through hole and the rotary shaft. The pump of Japanese Laid-open Patent Publication No. 6-101674 includes a lip seal and a labyrinth seal. The seals are fitted between the wall of a through hole of a partition that separates the oil chamber from the pump chamber and a rotary shaft that extends through the through hole.

If the labyrinth seal includes a plurality of annular grooves, seal performance is maintained over time. Further, if the volume of each annular groove is relatively large, the seal performance of the labyrinth seal is improved. However, in the aforementioned vacuum pumps, it is difficult to increase the volume of each annular groove due to limited space.

BRIEF SUMMARY OF THE INVENTION

Accordingly, it is an objective of the present invention to improve seal performance of a labyrinth seal that prevents oil from leaking to a pump chamber of a vacuum pump.

To achieve the foregoing and other objectives and in accordance with the purpose of the present invention, the present invention provides a vacuum pump that draws gas by operating a gas conveying body in a pump chamber through rotation of a rotary shaft. The vacuum pump includes an oil housing member, which forms an oil zone adjacent to the pump chamber. The rotary shaft has a projecting section that projects from the pump chamber to the oil zone through the oil housing member. An annular shaft seal is located around the projecting section to rotate integrally with the rotary shaft. The shaft seal has a first seal forming surface that extends in a radial direction of the shaft seal. A second seal forming surface is formed on the oil housing member. The second seal forming surface opposes the first seal forming surface and is substantially parallel with the first seal forming surface. A labyrinth seal is located between the first and second seal forming surfaces.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objectives and advantages thereof, may best be understood by reference to the following description of the presently preferred embodiments together with the accompanying drawings in which:

FIG. 1(*a*) is a cross-sectional plan view showing a multiple-stage Roots pump of a first embodiment according to the present invention;

FIG. 1(*b*) is an enlarged cross-sectional view showing a seal structure around a first rotary shaft of the pump of FIG. 1(*a*);

FIG. 1(*c*) is an enlarged cross-sectional view showing a seal structure around a second rotary shaft of the pump of FIG. 1(*a*);

FIG. 2(*b*) is a cross-sectional view taken along line 2*b*—2*b* of FIG. 1(*a*);

FIG. 3(*b*) is a cross-sectional view taken along line 3*b*—3*b* of FIG. 1(*a*);

FIG. 4(*a*) is a cross-sectional view taken along line 4*a*—4*a* of FIG. 3(*b*);

FIG. 4(*b*) is an enlarged cross-sectional view showing a major portion of FIG. 4(*a*);

FIG. 4(*c*) is a further enlarged cross-sectional view showing a portion of the seal structure of FIG. 4(*b*);

FIG. 5(*a*) is a cross-sectional view taken along line 5*a*—5*a* of FIG. 3(*b*);

FIG. 5(*b*) is an enlarged cross-sectional view showing a major portion of FIG. 5(*a*);

FIG. 5(*c*) is a further enlarged cross-sectional view showing a portion of the seal structure of FIG. 5(*b*);

DETAILED DESCRIPTION OF THE PREFERRED EMBODIMENTS

A first embodiment of a multiple-stage Roots pump 11 according to the present invention will now be described with reference to FIGS. 1(*a*) to 7.

Figure 2A:
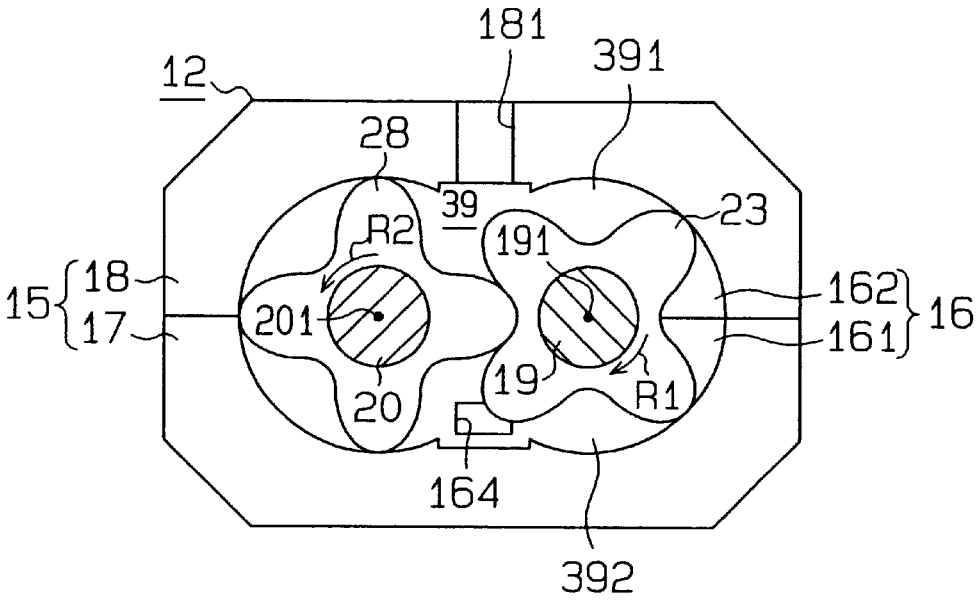
FIG. 2(*a*) is a cross-sectional view taken along line 2*a*—2*a* of FIG. 1(*a*)
Figure 2B:
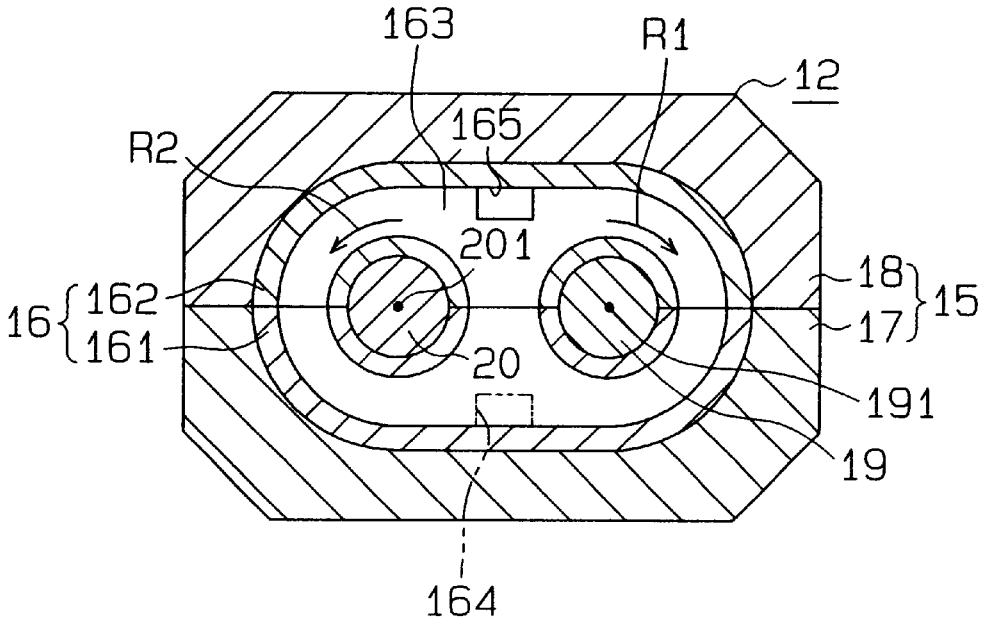

As shown in FIG. 1(*a*), the pump 11, or a vacuum pump, includes a rotor housing member 12 and a front housing member 13. The housing members 12, 13 are joined together. A lid 36 closes the front side of the front housing member 13. A rear housing member 14 is connected to the rear side of the rotor housing member 12. The rotor housing member 12 includes a cylinder block 15 and a plurality of (in this embodiment, four) chamber forming walls 16. As shown in FIG. 2(*b*), the cylinder block 15 includes a pair of block sections 17, 18, and each chamber forming wall 16 includes a pair of wall sections 161, 162. The chamber forming walls 16 are identical to one another.

As shown in FIG. 1(*a*), a first pump chamber 39 is formed between the front housing member 13 and the leftmost chamber forming wall 16, as viewed in the drawing. Second, third, and fourth pump chambers 40, 41, 42 are respectively formed between two adjacent chamber forming walls 16 in this order, as viewed from the left to the right in the drawing. A fifth pump chamber 43 is formed between the rear housing member 14 and the rightmost chamber forming wall 16.

A first rotary shaft 19 is rotationally supported by the front housing member 13 and the rear housing member 14 through a pair of radial bearings 21, 37. A second rotary shaft 20 is rotationally supported by the front housing member 13 and the rear housing member 14 through a pair of radial bearings 22, 38. The first and second rotary shafts 19, 20 are parallel with each other and extend through the chamber forming walls 16. The radial bearings 37, 38 are supported respectively by a pair of bearing holders 45, 46 that are installed in the rear housing member 14. The bearing holders 45, 46 are fitted respectively in a pair of recesses 47, 48 that are formed in the rear side of the rear housing member 14.

First, second, third, fourth, and fifth rotors 23, 24, 25, 26, 27 are formed integrally with the first rotary shaft 19. Likewise, first, second, third, fourth, and fifth rotors 28, 29, 30, 31, 32 are formed integrally with the second rotary shaft 20. As viewed in the directions of the axes 191, 201 of the rotary shafts 19, 20, the shapes and the sizes of the rotors 23–32 are identical. However, the axial dimensions of the first to fifth rotors 23–27 of the first rotary shaft 19 become gradually smaller in this order. Likewise, the axial dimensions of the first to fifth rotors 28–32 of the second rotary shaft 20 become gradually smaller in this order.

The first rotors 23, 28 are accommodated in the first pump chamber 39 as engaged with each other. The second rotors 24, 29 are accommodated in the second pump chamber 40 as engaged with each other. The third rotors 25, 30 are accommodated in the third pump chamber 41 as engaged with each other. The fourth rotors 26, 31 are accommodated in the fourth pump chamber 42 as engaged with each other. The fifth rotors 27, 32 are accommodated in the fifth pump chamber 43 as engaged with each other. The first to fifth pump chambers 3943 are non-lubricated. Thus, the rotors 23–32 are maintained in a non-contact state with any of the cylinder block 15, the chamber forming walls 16, the front housing member 13, and the rear housing member 14. Further, the engaged rotors do not slide against each other.

Figure 3A:
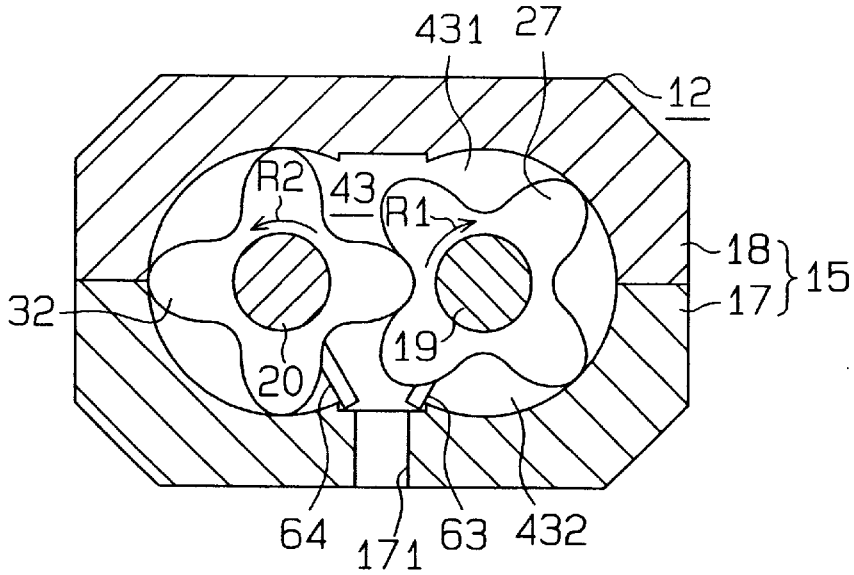
FIG. 3(*a*) is a cross-sectional view taken along line 3*a*—3*a* of FIG. 1(*a*)
Figure 3B:
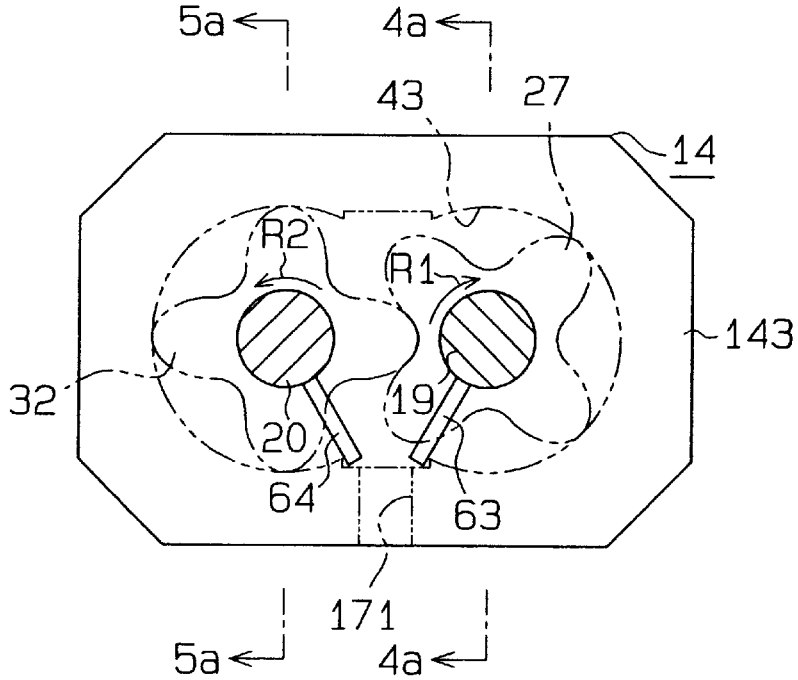
Figure 6:
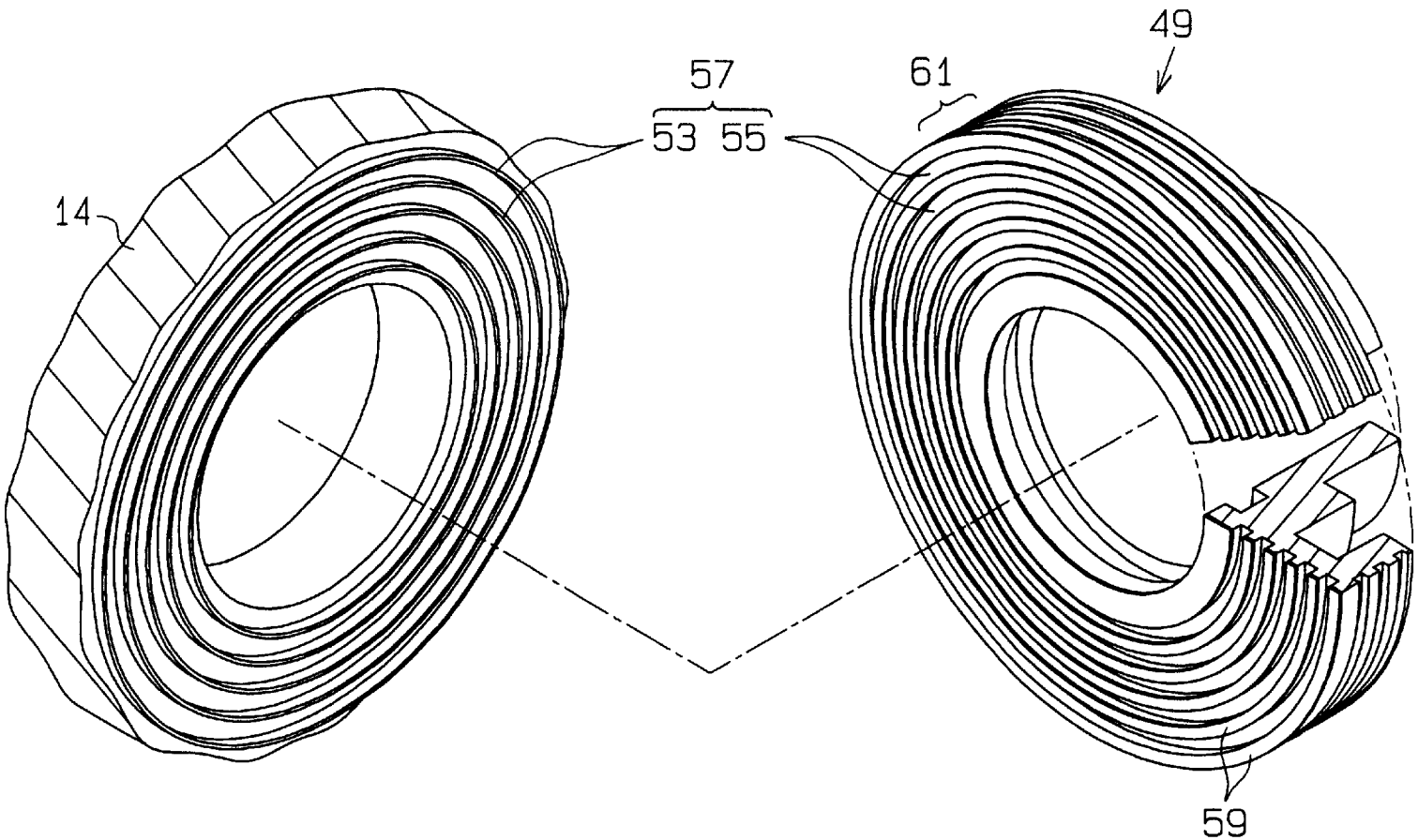
FIG. 6 is a perspective view showing a first annular shaft seal.
Figure 7:
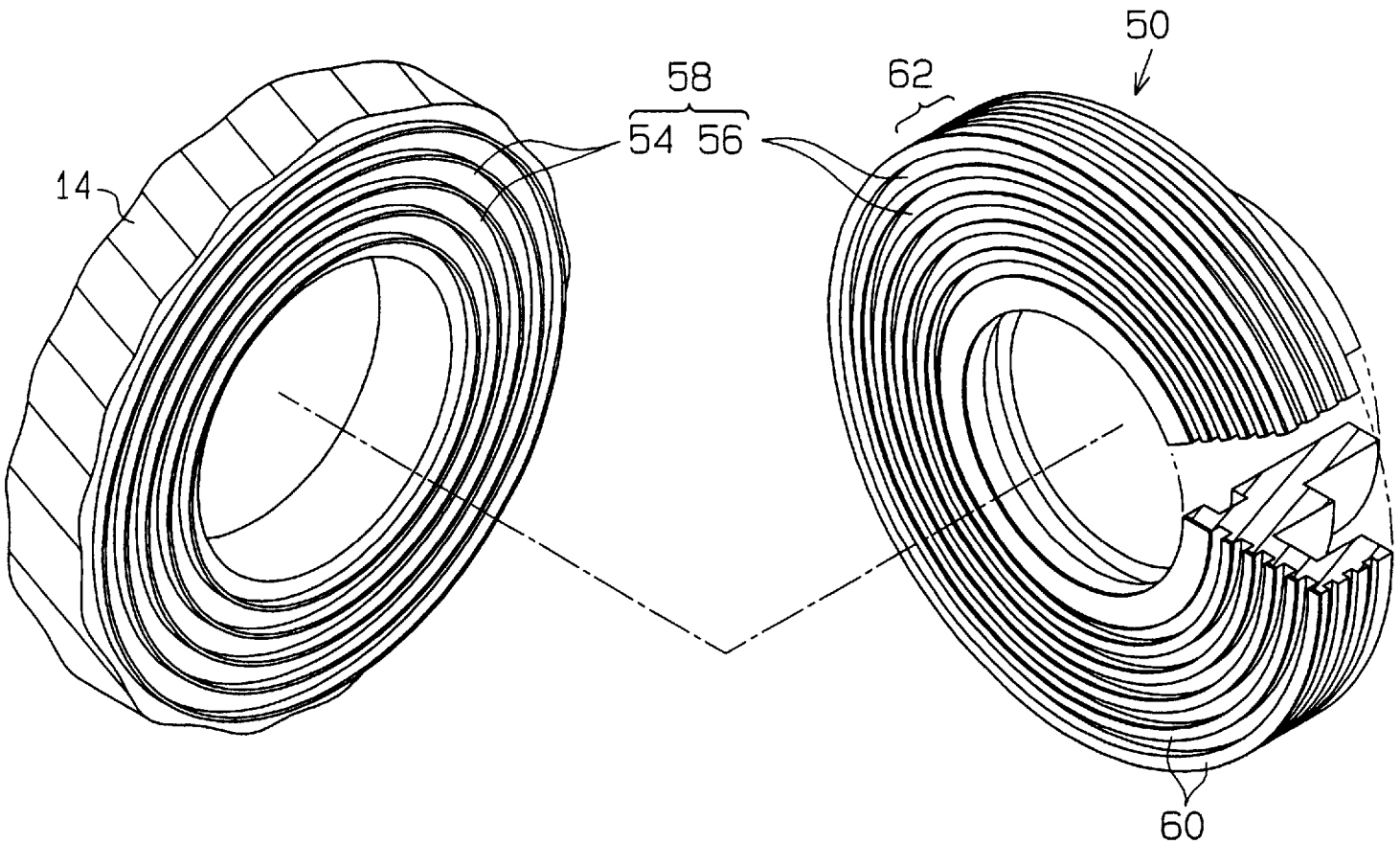
FIG. 7 is a perspective view showing a second annular shaft seal.

As shown in FIG. 2(*a*), the first rotors 23, 28 form a suction zone 391 and a pressure zone 392 in the first pump chamber 39. The pressure in the pressure zone 392 is higher than the pressure in the suction zone 391. The second to fourth rotors 24–26, 29–31 form similar suction zones and pressure zones in the associated pump chambers 40–42. As shown in FIG. 3(*a*), the fifth rotors 27, 32 form a suction zone 431 and a pressure zone 432, which are similar to the suction zone 391 and the pressure zone 392, in the fifth pump chamber 43.

As shown in FIG. 1(*a*), a gear housing member 33 is coupled with the rear housing member 14. A pair of through holes 141, 142 are formed in the rear housing member 14. The rotary shafts 19, 20 extend respectively through the through holes 141, 142 and the associated recesses 47, 48. The rotary shafts 19, 20 thus project into the gear housing member 33 to form projecting portions 193, 203, respectively. A pair of gears 34, 35 are secured respectively to the projecting portions 193, 203 and are meshed together. An electric motor M is connected to the gear housing member 33. A shaft coupling 44 transmits the drive force of the motor M to the first rotary shaft 19. The motor M thus rotates the first rotary shaft 19 in the direction indicated by arrow R1 of FIGS. 2(*a*) to 3(*b*). The gears 34, 35 transmit the rotation of the first rotary shaft 19 to the second rotary shaft 20. The second rotary shaft 20 thus rotates in the direction indicated by arrow R2 of FIGS. 2(*a*) to 3(*b*). Accordingly, the first and second rotary shafts 19, 20 rotate in opposite directions. The gears 34, 35 form a gear mechanism to rotate the rotary shafts 19, 20 integrally.

As shown in FIGS. 4(*a*) and 4(*b*), a gear accommodating chamber 331 is formed in the gear housing member 33 and retains lubricant oil Y for lubricating the gears 34, 35. The gear accommodating chamber 331 is a sealed oil zone. The gear housing member 33 and the rear housing member 14 thus form an oil housing, or an oil zone adjacent to the fifth pump chamber 43. The rear housing member 14 functions as a partition that separates the fifth pump chamber 43 from the oil zone. The gears 34, 35 rotate to agitate the lubricant oil Y in the gear accommodating chamber 331. The lubricant oil Y thus lubricates the radial bearings 37, 38. A gap 371, 381 of each radial bearing 37, 38 allows the lubricant oil Y to enter a portion of the associated recess 47, 48 that is located inward from the gap 371, 381. The recesses 47, 48 are thus connected to the gear accommodating chamber 331 through the gaps 371, 381 and form part of the oil zone.

As shown in FIG. 2(*b*), a passage 163 is formed in the interior of each chamber forming wall 16. Each chamber forming wall 16 has an inlet 164 and an outlet 165 that are connected to the passage 163. The adjacent pump chambers 39–43 are connected to each other by the passage 163 of the associated chamber forming wall 16.

As shown in FIG. 2(*a*), an inlet 181 extends through the block section 18 of the cylinder block 15 and is connected to the suction zone 391 of the first pump chamber 39. As shown in FIG. 3(*a*), an outlet 171 extends through the block section 17 of the cylinder block 15 and is connected to the pressure zone 432 of the fifth pump chamber 43. When gas enters the suction zone 391 of the first pump chamber 39 from the inlet 181, rotation of the first rotors 23, 28 sends the gas to the pressure zone 392. The gas is compressed in the pressure zone 392 and enters the passage 163 of the adjacent chamber forming wall 16 from the inlet 164. The gas thus reaches the suction zone of the second pump chamber 40 from the outlet 165 of the passage 163. Afterwards, the gas flows from the second pump chamber 40 to the third, fourth, and fifth pump chambers 41, 42, 43 in this order, as repeating the above-described procedure. The volumes of the first to fifth pump chambers 39–43 become gradually smaller in this order. When the gas reaches the suction zone 431 of the fifth pump chamber 43, rotation of the fifth rotors 27, 32 sends the gas to the pressure zone 432. The gas is then discharged from the outlet 171 to the exterior of the vacuum pump 11. That is, each rotor 23–32 functions as a gas conveying body for conveying gas.

The outlet 171 functions as a discharge passage for discharging gas to the exterior of the vacuum pump 11. The fifth pump chamber 43 is a final-stage pump chamber that is connected to the outlet 171. Among the pressure zones of the first to fifth pump chambers 39–43, the maximum pressure acts in the pressure zone 432 of the fifth pump chamber 43 such that the pressure zone 432 functions as a maximum pressure zone.

As shown in FIG. 1(*a*), first and second annular shaft seals 49, 50 are securely fitted around the first and second rotary shafts 19, 20, respectively. The shaft seals 49, 50 are located in the associated recesses 47, 48 and rotate integrally with the associated rotary shafts 19, 20. A seal ring 51 is located between the inner circumferential side of the shaft seal 49 and a circumferential side 192 of the first rotary shaft 19. In the same manner, a seal ring 52 is located between the inner circumferential side of the shaft seal 50 and a circumferential side 202 of the second rotary shaft 20. Each seal ring 51, 52 prevents the lubricant oil Y from leaking from the associated recess 47, 48 to the fifth pump chamber 43 along the circumferential side 192, 202 of the associated rotary shaft 19, 20.

As shown in FIGS. 4(*b*), 4(*c*), 5(*b*), and 5(*c*), there is a gap between an outer circumferential side 491, 501 of a portion with a maximum diameter of each shaft seal 49, 50 and the circumferential wall 471, 481 of the associated recess 47, 48. Likewise, there is a gap between a front side 492, 502 of each shaft seal 49, 50 and a bottom 472, 482 of the associated recess 47, 48.

A plurality of annular projections 53 coaxially project from the bottom 472 of the recess 47. In the same manner, a plurality of annular projections 54 coaxially project from the bottom 482 of the recess 48. Further, a plurality of annular grooves 55 are coaxially formed in the front side 492 of the shaft seal 49 that opposes the bottom 472 of the recess 47. In the same manner, a plurality of annular grooves 56 are coaxially formed in the front side 502 of the shaft seal 50 that opposes the bottom 482 of the recess 48. Each annular projection 53, 54 projects in the associated groove 55, 56 such that the distal end of the projection 53, 54 is located close to the bottom of the groove 55, 56. Each projection 53 divides the interior of the associated groove 55 of the first shaft seal 49 to a pair of labyrinth chambers 551, 552. Each projection 54 divides the interior of the associated groove 56 of the second shaft seal 50 to a pair of labyrinth chambers 561, 562.

The projections 53 and the grooves 55 form a first labyrinth seal 57 corresponding to the first rotary shaft 19. The projections 54 and the grooves 56 form a second labyrinth seal 58 corresponding to the second rotary shaft 20. In this embodiment, the front sides 492, 502 and the bottoms 472, 482 each form a plane perpendicular to the axis 191, 201 of the associated rotary shaft 19, 20. In other words, the front sides 492, 502 and the bottoms 472, 482 are seal forming surfaces that extend in a radial direction of the associated shaft seals 49, 50.

As shown in FIG. 4(*c*), a resin layer 59 is securely applied on the front side 492 of the first shaft seal 49. As shown in FIG. 5(*c*), a resin layer 60 is securely applied on the front side 502 of the second shaft seal 50. A gap g1 between the resin layer 59 and the bottom 472 is smaller than a gap G1 between the distal end of each projection 53 and the bottom of the associated groove 55. A gap g2 between the resin layer 60 and the bottom 482 is smaller than a gap G2 between the distal end of each projection 54 and the bottom of the associated groove 56. Each gap G1, G2 is substantially equal to the gap between the outer circumferential side 491, 502 of the associated shaft seal 49, 50 and the circumferential wall 471, 481 of the recesses 47, 48. The gap g1 is a minimum gap between the first shaft seal 49 and the rear housing member 14. The gap g2 is a minimum gap between the second shaft seal 50 and the rear housing member 14. In the present invention, the term "minimum gap" refers to a gap with a dimension that improves sealing of the labyrinth chambers.

As shown in FIGS. 1(*b*), 4(*b*), and 6, a first helical groove 61 is formed in the outer circumferential side 491 of the first shaft seal 49. As shown in FIGS. 1(*c*), 5(*b*), and 7, a second helical groove 62 is formed in the outer circumferential side 501 of the second shaft seal 50. The first helical groove 61 forms a path from a side corresponding to the gear accommodating chamber 331 toward the fifth pump chamber 43 as viewed in the rotational direction R1 of the first rotary shaft 19. The second helical groove 62 forms a path from a side corresponding to the gear accommodating chamber 331 toward the fifth pump chamber 43 as viewed in the rotational direction R2 of the second rotary shaft 20. In this manner, each helical groove 61, 62 brings out a pumping effect that conveys fluid from a side corresponding to the fifth pump chamber 43 toward the gear accommodating chamber 331 when the rotary shafts 19, 20 rotate. That is, each helical groove 61, 62 forms a pumping means that urges the lubricant oil Y between the outer circumferential side 491, 501 of the associated shaft seal 49, 50 and the circumferential wall 471, 481 of the recess 47, 48 to move from a side corresponding to the fifth pump chamber 43 toward the oil zone.

As shown in FIG. 3(*b*), first and second discharge pressure introducing lines 63, 64 are formed in a chamber forming wall surface 143 of the rear housing member 14 that forms the final-stage fifth pump chamber 43. As shown in FIG. 4(*a*), the first discharge pressure introducing line 63 is connected to the maximum pressure zone 432 the volume of which is varied by rotation of the fifth rotors 27, 32. The first discharge pressure introducing line 63 is connected also to the through hole 141 through which the first rotary shaft 19 extends. As shown in FIG. 5(*a*), the second discharge pressure introducing line 64 is connected to the maximum pressure zone 432 and the through hole 142 through which the second rotary shaft 20 extends.

As shown in FIGS. 1(*a*), 4(*a*), and 5(*a*), an annular cooling chamber 65 is formed in the rear housing member 14 to surround the shaft seals 49, 50. Coolant water circulates in the cooling chamber 65 to cool the lubricant oil Y in the recesses 47, 48.

The first embodiment has the following effects.

The front side 492, 502 of each shaft seal 49, 50, which is fitted around the associated rotary shaft 19, 20, has a diameter larger than that of the circumferential side 192, 202 of the rotary shaft 19, 20. In this embodiment, each labyrinth seal 57, 58 is located between the front side 492, 502 of the associated shaft seal 49, 50 and the bottom 472, 482 of the recess 47, 48. Thus, as compared to the case in which a labyrinth seal is located between the circumferential side 192, 202 of each rotary shaft 19, 20 and the rear housing member 14, the diameter of each labyrinth seal 57, 58 is relatively large. The larger the diameter of each labyrinth seal 57, 58 is, the greater the volume of each labyrinth chamber 551, 552, 561, 562 is. This improves the seal performance of the labyrinth seals 57, 58. Thus, arrangement of each labyrinth seal 57, 58 of this embodiment is preferable in increasing the volume of each labyrinth chamber 551, 552, 561, 562 for improving the seal performance of the labyrinth seals 57, 58.

The smaller the gap between the wall of each recess 47, 48 and the associated shaft seal 49, 50 is, the less likely it is for the lubricant oil Y to enter this gap. In this embodiment, the bottom 472, 482 of each recess 47, 48 and the front side 492, 502 of the associated shaft seal 49, 50 can be located close to each other in a uniform manner at the substantially entire area. This makes it easy to minimize the minimum gaps g1, g2. The smaller each minimum gap g1, g2 is, the greater the seal performance of the associated labyrinth seal 57, 58 is. Accordingly, the location of each labyrinth seal 57, 58 of this embodiment is preferable.

When the Roots pump 11 is completely assembled, the resin layer 59, 60 of each shaft seal 49, 50 is in contact with the bottom 472, 482 of the associated recess 47, 48. The recesses 47, 48 are located in the rear housing member 14 that is formed of metal. When the Roots pump 11 operates, the resin layers 59, 60 simply slide along the bottoms 472, 482 of the associated recesses 47, 48 without affecting rotation of each rotary shaft 19, 20.

More specifically, when manufacturing the Roots pump 11, the total (F1+d1) of the depth F1 of each annular groove 55 (see FIG. 4(*c*)) and the thickness d1 of the resin layer 59 (see FIG. 4(*c*)) is selected to be slightly larger than the projecting amount H1 of each annular projection 53 (see FIG. 4(*c*)). The first rotary shaft 19 and the first shaft seal 49 are then assembled together such that the resin layer 59 contacts the bottom 472 of the recess 47. In this state, the first rotary shaft 19 is allowed to rotate smoothly. Likewise, the total (F2+d2) of the depth F2 of each annular groove 56 (see FIG. 5(*c*)) and the thickness d2 of the resin layer 60 (see FIG. 5(*c*)) is selected to be slightly larger than the projecting amount H2 of each annular projection 54 (see FIG. 5(*c*)). The second rotary shaft 20 and the second shaft seal 50 are then assembled together such that the resin layer 60 contacts the bottom 482 of the recess 48. In this state, the second rotary shaft 20 is allowed to rotate smoothly.

Accordingly, each resin layer 59, 60 minimizes the minimum gap g1, g2 between the shaft seal 49, 50 and the rear housing member 14. If sealing of each labyrinth chamber 551, 552, 561, 562 is improved, the seal performance of each labyrinth seal 57, 58 is also improved. The improved sealing of the labyrinth chambers 551, 552, 562, 562 can be achieved by reducing the volume of each minimum gap g1, g2. That is, each resin layer 59, 60 of this embodiment improves the seal performance of the labyrinth seals 57, 58.

As described, each resin layer 59, 50 contacts the bottom 472, 482 of the associated recess 47, 48 without hampering the rotation of each rotary shaft 19, 20. Thus, locating each resin layer 59, 60 at the front side 492, 502 of the associated shaft seal 49, 50 is preferable in minimizing the minimum gaps g1, g2.

The labyrinth seals 57, 58 also stop gas leak. More specifically, when the Roots pump 11 operates, the pressure in each pump chamber 39–43 exceeds the atmospheric pressure. However, each labyrinth seal 57, 58 prevents gas from leaking from the fifth pump chamber 43 to the gear accommodating chamber 331 along the surface of the associated shaft seal 49, 50. That is, the labyrinth seals 57, 58 stop both oil leak and gas leak and are optimal non-contact type seals.

During the rotation of the first rotary shaft 19, the first helical groove 61 of the first shaft seal 49 forms a path along the circumferential wall 471 of the recess 47. This sends the lubricant oil Y corresponding to the path of the first helical groove 61 from a side corresponding to the fifth pump chamber 43 toward the gear accommodating chamber 331. In the same manner, the second helical groove 62 of the second shaft seal 50 forms a path along the circumferential wall 481 of the recess 48 during the rotation of the second rotary shaft 20. The lubricant oil Y corresponding to the path of the second helical groove 62 thus flows from a side corresponding to the fifth pump chamber 43 toward the gear accommodating chamber 331. Accordingly, the shaft seals 49, 50 with the helical grooves 61, 62, each of which functions as the pumping means, have an improved seal performance against the lubricant oil Y.

Each helical groove 61, 62 is located along the outer circumferential side 491, 501 of the associated shaft seal 49, 50, or the outer circumferential side of the portion with the maximum diameter of the shaft seal 49, 50. The circumferential speed thus becomes maximum at the portion at which each helical groove 61, 62 is located. Accordingly, each helical groove 61, 62 rotates at a relatively high speed. This efficiently urges the gas between the outer circumferential side 491, 501 of each shaft seal 49, 50 and the circumferential wall 471, 481 of the associated recess 47, 48 to move from a side corresponding to the fifth pump chamber 43 toward the gear accommodating chamber 331. The lubricant oil Y between the outer circumferential side of 491, 501 of each shaft seal 49, 50 and the circumferential wall 471, 481 of the associated recess 47, 48 follows the movement of the gas, thus efficiently moving from a side corresponding to the fifth pump chamber 43 toward the gear accommodating chamber 331. The location of each helical groove 61, 62 of this embodiment is thus preferable in preventing oil from leaking from the recesses 47, 48 to the fifth pump chamber 43.

If the number of the rotation cycles of each helical groove 61, 62 increases, the seal performance of each shaft seal 49, 50 improves. Since it is relatively easy to increase the number of the rotation cycles of the each helical groove 61, 62, the helical grooves 61, 62 are preferable pumping means.

Each rotary shaft 19, 20 includes a plurality of rotors that are formed integrally with the rotary shaft 19, 20. Thus, if each shaft seal 49, 50 is formed integrally with the associated rotary shaft 19, 20, the maximum diameter of the shaft seal 49, 50 must be selected with reference to the diameter of each through hole 141, 142 of the rear housing member 14. However, in this embodiment, each shaft seal 49, 50 is formed separately from the associated rotary shaft 19, 20. It is thus possible to shape and size the shaft seals 49, 50 to advantageously improve the pumping effect of the pumping means.

The circumferential side 192 of the first rotary shaft 19 forms a slight gap with respect to the wall of the through hole 141. Also, each fifth rotor 27, 32 forms a slight gap with respect to the chamber forming wall surface 143 of the rear housing member 14. These gaps introduce the pressure in the final-stage, fifth pump chamber 43 to the first labyrinth seal 57. Further, the circumferential side 202 of the second rotary shaft 20 forms a slight gap with respect to the wall of the through hole 142. The pressure in the fifth pump chamber 43 is thus introduced to the second labyrinth seal 58.

Without the discharge pressure introducing lines 63, 64, the labyrinth seals 57, 58 are equally affected by the pressure in the suction zone 431 and the pressure in the pressure zone 432 of the fifth pump chamber 43. More specifically, if the pressure in the suction zone 431 is P1 and the pressure in the maximum pressure zone 432 is P2 (P2>P1), each labyrinth seal 57, 58 receives about half the total of the pressures P1, P2 ((P2+P1)/2) from the fifth pump chamber 43.

The pressure in each recess 47, 48, which is connected to the gear accommodating chamber 331, corresponds to the atmospheric pressure (approximately 1000 Torr) that remains non-affected by operation of each rotor 23–32. The pumping effect of the helical grooves 61, 62 reduces the pressure in the space between each shaft seal 49, 50 and the wall of the associated recess 47, 48 to a level P3 lower than the atmospheric pressure at the portion between each helical groove 61, 62 and the associated labyrinth seal 57, 58. Accordingly, if the pump 11 does not have the discharge pressure introducing lines 63, 64, the pressure difference between the radial inner end and the radial outer end of each labyrinth seal 57, 58 becomes approximately P3–(P2+P1)/2.

Each discharge pressure introducing line 63, 64 of this embodiment improves the effect of introducing the pressure in the maximum pressure zone 432 to the associated labyrinth seals 57, 58. That is, the effect of introducing the pressure in the maximum pressure zone 432 to the labyrinth seals 57, 58 through the discharge pressure introducing lines 63, 64 dominates the effect of introducing the pressure in the suction zone 431 to the labyrinth seals 57, 58. Thus, the pressure received by each labyrinth seal 57, 58 becomes much larger than the aforementioned value (P2+P1)/2. Accordingly, the pressure difference between the radial inner end and the radial outer end of each labyrinth seal 57, 58 becomes much smaller than the value P3–(P2+P1)/2. As a result, the oil leak preventing effect of each labyrinth seal 57, 58 is improved.

The effect of introducing the pressure in the maximum pressure zone 432 to each labyrinth seal 57, 58 depends on the communication area of each discharge pressure introducing line 63, 64. Since the discharge pressure introducing line 63, 64 with a desired communication area is easy to accomplish, the discharge pressure introducing lines 63, 64 optimally introduce the pressure in the maximum pressure zone 432 to the labyrinth seals 57, 58.

The discharge pressure introducing lines 63, 64 are located in the chamber forming wall surface 143 that forms the fifth pump chamber 43. Each through hole 141, 142, through which the associated rotary shaft 19, 20 extends, is formed in the chamber forming wall surface 143. The maximum pressure zone 432 of the fifth pump chamber 43 faces the chamber forming wall surface 143. Accordingly, each discharge pressure introducing line 63, 64 is readily formed in the chamber forming wall surface 143 such that the line 63, 64 is connected to the maximum pressure zone 432 and the associated through hole 141, 142.

If the Roots pump 11 is a dry type, the lubricant oil Y does not circulate in any pump chamber 39–43. It is preferred that the present invention be applied to this type of pump.

The present invention may be modified, as shown in second to eight embodiments of FIGS. 8 to 14. Although only the labyrinth seal for the first rotary shaft 19 is illustrated in FIGS. 8 to 13, an identical labyrinth seal is provided for the second rotary shaft 20 of these embodiments.

Figure 8:
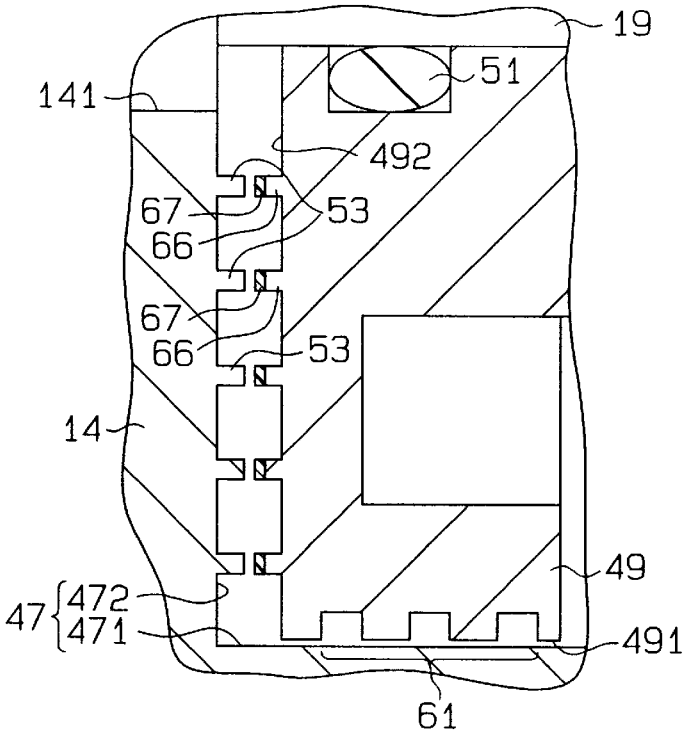
FIG. 8 is a cross-sectional view showing a major portion of a seal structure of a second embodiment according to the present invention.

In the second embodiment, as shown in FIG. 8, a plurality of annular projections 66 that project from the front side 492 of the shaft seal 49 oppose the annular projections 53, which project from the bottom 472 of the recess 47. A resin layer 67 is formed at the distal end of each projection 66. The annular projections 66, 53 form a labyrinth seal.

Figure 9:
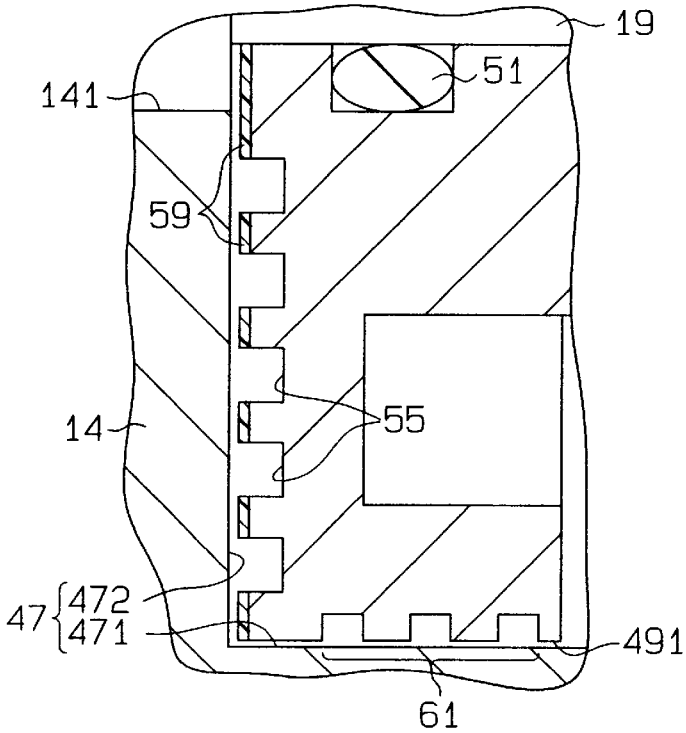
FIG. 9 is a cross-sectional view showing a major portion of a seal structure of a third embodiment according to the present invention.

As shown in FIG. 9, the third embodiment does not include the annular projections 53 that otherwise project from the bottom 472 of the recess 47, unlike the first embodiment. Instead, the annular grooves 55 formed in the shaft seal 49 form a labyrinth seal.

Figure 10:
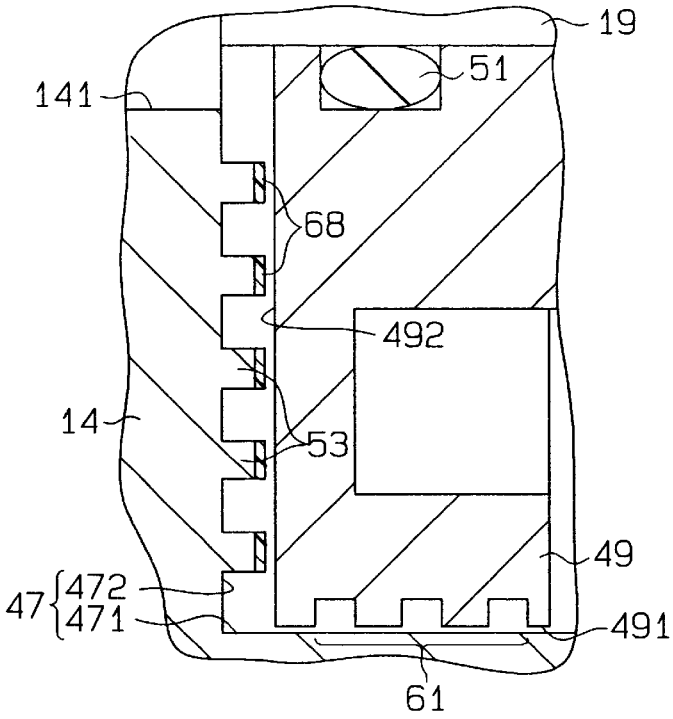
FIG. 10 is a cross-sectional view showing a major portion of a seal structure of a fourth embodiment according to the present invention.

As shown in FIG. 10, the fourth embodiment does not include the annular grooves 55 that are otherwise formed in the shaft seal 49, unlike the first embodiment. Instead, the annular projections 53 projecting from the bottom 472 of the recess 47 form a labyrinth seal. A resin layer 68 is formed at the distal end of each projection 53.

Figure 11:
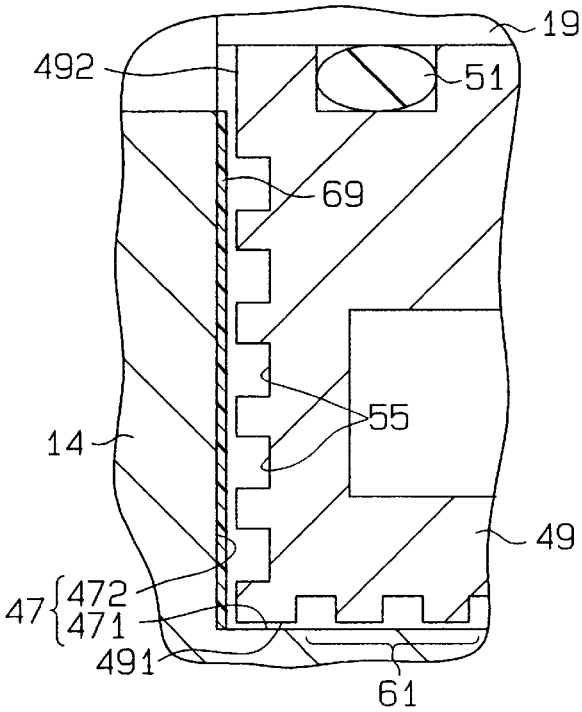
FIG. 11 is a cross-sectional view showing a major portion of a seal structure of a fifth embodiment according to the present invention.

As shown in FIG. 11, the fifth embodiment does not include the annular projections 53 that otherwise project from the bottom 472 of the recess 47, unlike the first embodiment. Instead, the annular grooves 55 of the shaft seal 49 form a labyrinth seal. A resin layer 69 is formed on the bottom 472 of the recess 47.

Figure 12:
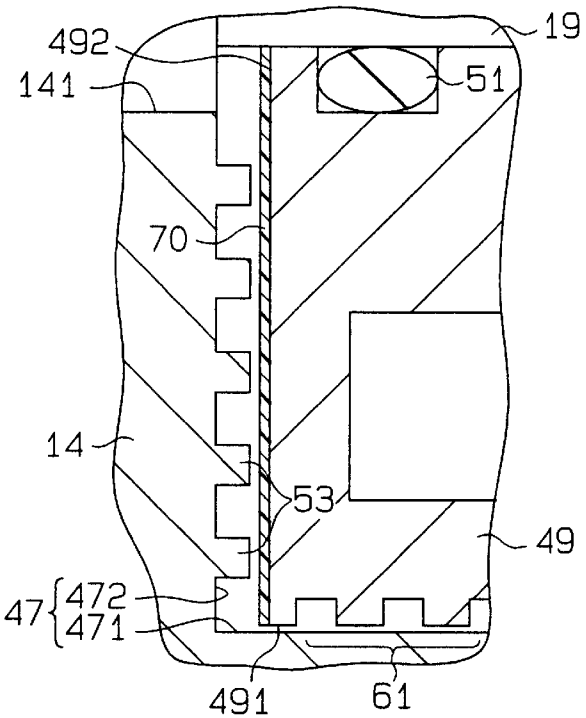
FIG. 12 is a cross-sectional view showing a major portion of a seal structure of a sixth embodiment according to the present invention.

As shown in FIG. 12, the sixth embodiment does not include the annular grooves 55 that are otherwise formed in the shaft seal 49, unlike the first embodiment. Instead, the annular projections 53 projecting from the bottom 472 of the recess 47 form a labyrinth seal. A resin layer 70 is formed at the front side 492 of the shaft seal 49.

Figure 13:
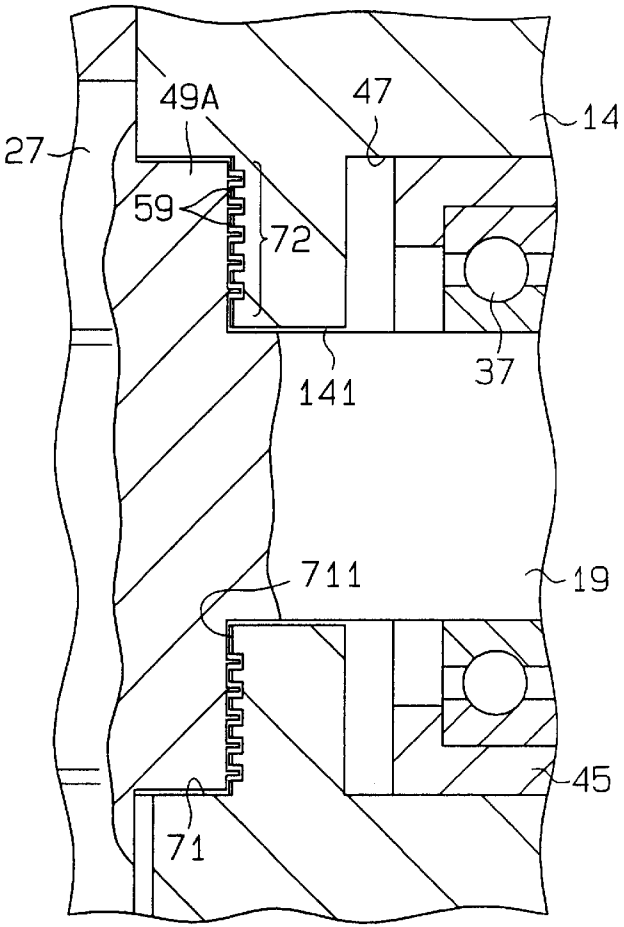
FIG. 13 is a cross-sectional view showing a major portion of a seal structure of a seventh embodiment according to the present invention.

In the seventh embodiment, as shown in FIG. 13, a shaft seal 49A is formed integrally with the rotary shaft 19 and is connected to the fifth rotor 27. The shaft seal 49A is accommodated in a recess 71 formed in the side of the rear housing member 14 that opposes the rotor housing member 12. A labyrinth seal 72 is located between the rear side of the shaft seal 49A and a bottom 711 of the recess 71.

Figure 14:
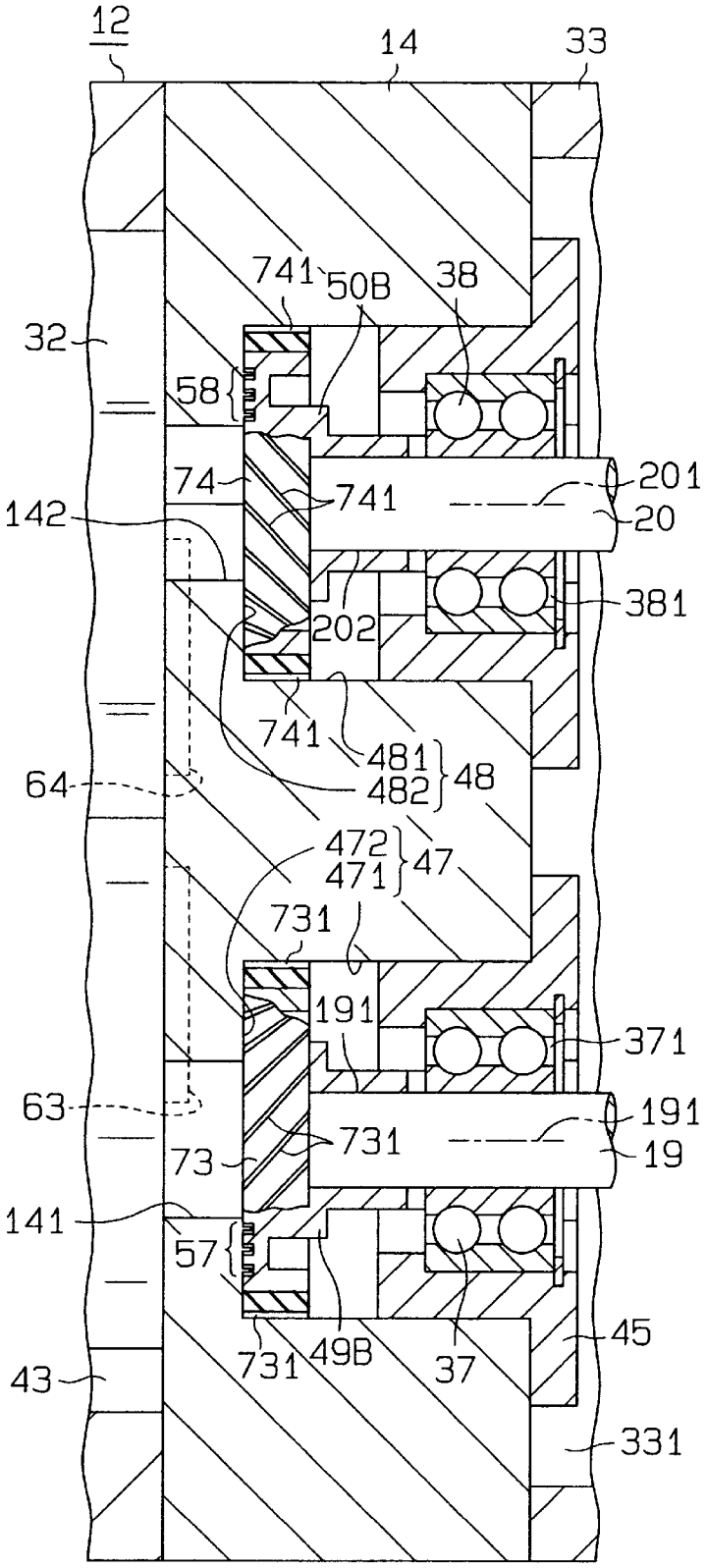
FIG. 14 is a cross-sectional view showing a major portion of a seal structure of an eighth embodiment according to the present invention.

As shown in FIG. 14, the eighth embodiment includes a pair of shaft seals 49B, 50B. A pair of rubber sliding rings 73, 74 are respectively fitted around the shaft seals 49B, 50B. A plurality of leak preventing projections 731 are formed around the sliding ring 73, and a plurality of leak preventing projections 741 are formed around the sliding ring 74. When the first rotary shaft 19 rotates, the leak preventing projections 731 slide along the circumferential wall 471 of the recess 47 in a contact manner. Likewise, when the second rotary shaft 20 rotates, the leak preventing projections 741 slide along the circumferential wall 481 of the recess 48 in a contact manner. Each leak preventing projection 731, 741 does not cover the entire circumference around the axis of the associated shaft seal 49B, 50B, or the axis 191, 201 of the associated rotary shaft 19, 20, and is formed diagonally with respect to the axis 191, 201. Each leak preventing projection 731, 741 forms a path from a side corresponding to the gear accommodating chamber 331 toward the fifth pump chamber 43, as viewed in the rotational direction R1, R2 of the associated rotary shaft 19, 20.

When the first rotary shaft 19 rotates, the leak preventing projections 731 urge the lubricant oil Y between the circumferential wall 471 of the recess 47 and the outer circumferential side of the first shaft seal 49B to move from a side corresponding to the fifth pump chamber 43 toward the gear accommodating chamber 331. In the same manner, when the second rotary shaft 20 rotates, the leak preventing projections 741 urge the lubricant oil Y between the circumferential wall 481 of the recess 48 and the outer circumferential side of the second shaft seal 50B to move from a side corresponding to the fifth pump chamber 43 toward the gear accommodating chamber 331.

If a single leak preventing projection is formed around the entire circumference around the axis 191, 201 of each rotary shaft 19, 20, the axial dimension of each sliding ring 73, 74 needs to be enlarged. In this case, the resistance to the sliding of each sliding ring 73, 74 becomes relatively large, which is not preferable. In contrast, the leak preventing projections 731, 741 of the eighth embodiment do not require the enlargement of the axial dimensions of the sliding rings 73, 74.

The present invention may be modified as follows.

The bottom of each recess 47, 48 and the front side of the associated shaft seal 49, 50 may be tapered such that a labyrinth seal is located between the opposed tapered surfaces.

In the first embodiment, a resin layer may be applied at the distal end of each projection 53, 54.

A resin plate may be located between the bottom 472, 482 of each recess 47, 48 and the front side 492, 502 of the associated shaft seal 49, 50, thus forming a resin layer.

The present invention may be applied to other types of vacuum pumps than Roots types.

The present example and embodiments are to be considered as illustrative and not restrictive and the invention is not to be limited to the details given herein, but may be modified within the scope and equivalence of the appended claims.

What is claimed is:

1. A vacuum pump that draws gas by operating a gas conveying body in a pump chamber through rotation of a rotary shaft, the vacuum pump comprising:

an oil housing member, wherein the oil housing member forms an oil zone adjacent to the pump chamber, and the rotary shaft has a projecting section that projects from the pump chamber to the oil zone through the oil housing member;

an annular shaft seal, which is located around the projecting section to rotate integrally with the rotary shaft, wherein the shaft seal has a first seal forming surface that extends in a radial direction of the shaft seal;

a second seal forming surface, which is directly formed on the oil housing member, wherein the second seal forming surface opposes the first seal forming surface and is substantially parallel with the first seal forming surface; and a labyrinth seal, which is located between the first and second seal forming surfaces.

2. The vacuum pump according to claim 1, wherein the oil housing member has a recess in which the shaft seal is accommodated, and the second seal forming surface forms a wall portion of the recess.

3. The vacuum pump according to claim 2, wherein the first seal forming surface is an end surface of the shaft seal, and the second seal forming surface is a bottom of the recess.

4. The vacuum pump according to claim 2, wherein the shaft seal includes a pumping means that urges oil between the shaft seal and a surface forming the recess to move from a side corresponding to the pump chamber toward the oil zone.

5. The vacuum pump according to claim 4, wherein the pumping means is located at an outer circumferential side of the shaft seal.

6. The vacuum pump according to claim 4, wherein the pumping means is a helical groove, and the helical groove forms a path from a side corresponding to the oil zone toward the pump chamber as viewed in a rotational direction of the rotary shaft.

7. The vacuum pump according to claim 1, wherein the shaft seal is formed independently from the rotary shaft, a seal ring is located between the shaft seal and the rotary shaft, and the seal ring prevents the oil from leaking from the oil zone to the pump chamber along a circumferential side of the rotary shaft.

8. The vacuum pump according to claim 1, wherein the labyrinth seal includes a resin layer that is formed on at least one of the shaft seal and the oil housing member.

9. The vacuum pump according to claim 1, wherein the oil housing member includes a through hole through which the rotary shaft extends, and the vacuum pump includes a pressure introducing line that introduces the pressure of the gas discharged from the pump chamber to the exterior of the vacuum pump to the through hole.

10. The vacuum pump according to claim 9, wherein the pressure introducing line introduces the pressure in a maximum pressure zone located in the pump chamber to the labyrinth seal through the through hole.

11. The vacuum pump according to claim 9, wherein the pressure introducing line is formed in the oil housing member.

12. The vacuum pump according to claim 10, wherein the oil housing member has a wall surface exposed to the maximum pressure zone, and the pressure introducing line is a groove formed in the wall surface.

13. The vacuum pump according to claim 1, further comprising a bearing that supports the rotary shaft, wherein the bearing is supported by the oil housing member and is located in the oil zone.

14. The vacuum pump according to claim 1, wherein the rotary shaft is one of a plurality of parallel rotary shafts, a gear mechanism connects the rotary shafts to one another such that the rotary shafts rotate integrally, and the gear mechanism is located in the oil zone.

15. The vacuum pump according to claim 14, wherein a plurality of rotors are formed around each rotary shaft such that each rotor functions as the gas conveying body, and the rotors of one rotary shaft are engaged with the rotors of another rotary shaft.

16. A Roots pump, comprising:

a housing, wherein the housing has a pump chamber and an oil zone, and the housing includes a partition that separates the pump chamber from the oil zone;

a pair of parallel rotary shafts, wherein each rotary shaft extends from the pump chamber to the oil zone through the partition;

a pair of rotors, each of which is located in the pump chamber and is formed around one of the rotary shafts, wherein the rotor of one rotary shaft engages with the rotor of the other;

a gear mechanism, which is located in the oil zone, wherein the gear mechanism connects the rotary shafts to each other such that the rotary shafts rotate integrally;

a pair of annular shaft seals, each of which is located in the oil zone and is fitted around one of the rotary shafts to rotate integrally with the rotary shaft, wherein each shaft seal has a first seal forming surface perpendicular to the axis of the associated rotary shaft;

a pair of second seal forming surfaces, which are directly formed on the partition, wherein each second seal forming surface opposes one of the first seal forming surfaces and is substantially parallel with the first seal forming surface; and a pair of labyrinth seals, each of which is located between one of the first seal forming surfaces and the associated second seal forming surface.

17. The Roots pump according to claim 16, wherein the partition includes a pair of recesses, in each of which one of the shaft seals is accommodated, and each second seal forming surface is a bottom of one of the recesses.

18. The Roots pump according to claim 17, wherein each shaft seal includes a pumping means that urges oil between an outer circumferential side of the shaft seal and a circumferential wall of the associated recess to move from a side corresponding to the pump chamber toward the oil zone.

19. The Roots pump according to claim 18, wherein each pumping means is a helical groove formed in the outer circumferential side of the associated shaft seal, and the helical groove forms a path from a side corresponding to the oil zone toward the pump chamber as viewed in a rotational direction of the associated rotary shaft.

20. The Roots pump according to claim 16, wherein each labyrinth seal includes a resin layer formed on at least one of the associated shaft seal and the partition.

21. A vacuum pump that draws gas by operating a gas conveying body in a pump chamber through rotation of a rotary shaft, the vacuum pump comprising:

an oil housing member, wherein the oil housing member forms an oil zone adjacent to the pump chamber, and the rotary shaft has a projecting section that projects from the pump chamber to the oil zone through a through hole formed in the oil housing member;

an annular shaft seal, which is located around the projecting section to rotate integrally with the rotary shaft, wherein the shaft seal has a first seal forming surface that extends in a radial direction of the shaft seal;

a second seal forming surface, which is formed on the oil housing member, wherein the second seal forming surface opposes the first seal forming surface and is substantially parallel with the first seal forming surface;

a labyrinth seal, which is located between the first and second seal forming surfaces; and a pressure introducing line that introduces the pressure in a maximum pressure zone located in the pump chamber to the labyrinth seal through the through hole, wherein the oil housing member has a wall surface exposed to the maximum pressure zone, and the pressure introducing line is a groove formed in the wall surface.

* * * * *

UNITED STATES PATENT AND TRADEMARK OFFICE

CERTIFICATE OF CORRECTION

PATENT NO. : 6,659,747 B2 
DATED : December 9, 2003
INVENTOR(S) : Shinya Yamamoto et al.

It is certified that error appears in the above-identified patent and that said Letters Patent is hereby corrected as shown below:

Column 3,
Line 63, please delete "3943" and insert therefore -- 39-43 --

Signed and Sealed this

Sixth Day of April, 2004

JON W. DUDAS
*Acting Director of the United States Patent and Trademark Office*